US010718148B2

(12) United States Patent
Ghannam et al.

(10) Patent No.: US 10,718,148 B2
(45) Date of Patent: Jul. 21, 2020

(54) VEHICLE DOOR ASSISTANCE

(71) Applicant: Ford Global Technologies, LLC, Dearborn, MI (US)

(72) Inventors: Mahmoud Yousef Ghannam, Canton, MI (US); Howard Churchwell, II, Monroe, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 149 days.

(21) Appl. No.: 15/623,072

(22) Filed: Jun. 14, 2017

(65) Prior Publication Data

US 2018/0363353 A1 Dec. 20, 2018

(51) Int. Cl.

| | |
|---|---|
| ***E05F 15/20*** | (2006.01) |
| ***E05F 15/60*** | (2015.01) |
| ***E05B 77/02*** | (2014.01) |
| ***E05B 77/12*** | (2014.01) |
| ***E05C 17/00*** | (2006.01) |
| ***E05F 15/72*** | (2015.01) |
| ***E05B 81/76*** | (2014.01) |
| *E05F 15/611* | (2015.01) |

(52) U.S. Cl.

CPC ..... *E05F 15/60* (2015.01); *E05B 77/02* (2013.01); *E05B 77/12* (2013.01); *E05B 81/76* (2013.01); *E05C 17/003* (2013.01); *E05F 15/72* (2015.01); *E05F 15/611* (2015.01); *E05Y 2400/31* (2013.01); *E05Y 2400/32* (2013.01); *E05Y 2400/36* (2013.01); *E05Y 2400/44* (2013.01); *E05Y 2400/612* (2013.01); *E05Y 2400/818* (2013.01); *E05Y 2400/854* (2013.01); *E05Y 2800/112* (2013.01); *E05Y 2800/113* (2013.01); *E05Y 2800/252* (2013.01); *E05Y 2900/531* (2013.01)

(58) Field of Classification Search

CPC ..... E05F 15/60; E05F 15/72; E05B 81/76; E05Y 2900/531

USPC ..... 49/31

See application file for complete search history.

(56) References Cited

U.S. PATENT DOCUMENTS

| | | | |
|---|---|---|---|
| 7,726,722 | B2 | 6/2010 | Ray |
| 2004/0059488 | A1 | 3/2004 | Iida |

(Continued)

FOREIGN PATENT DOCUMENTS

| | | | |
|---|---|---|---|
| DE | 19927871 | A1 | 11/1999 |
| DE | 19947363 | A1 | 4/2001 |

(Continued)

OTHER PUBLICATIONS

Powered Door System, Integrated Systems, Control Solutions.

Search Report dated Dec. 12, 2018 for GB Patent Application No. GB 1809613.1 (5 pages).

*Primary Examiner* — Jerry E Redman

(74) *Attorney, Agent, or Firm* — Frank Lollo; Eversheds Sutherland (US) LLP

(57) ABSTRACT

Method and apparatus are disclosed for vehicle door assistance. An example vehicle includes a solenoid between a frame of the vehicle and a door, a restraint control module with an accelerometer to provide a roll angle and a pitch angle of the vehicle; and a body control unit. The body control unit determines a door adjustment force based on the roll and pitch angles and personal characteristics of an occupant, and when a door is moving, applies the door adjustment force with the solenoid.

13 Claims, 6 Drawing Sheets

(56) References Cited

U.S. PATENT DOCUMENTS

| | | | | |
|---|---|---|---|---|
| 2005/0240331 | A1 | 10/2005 | Nowak et al. | |
| 2012/0053754 | A1* | 3/2012 | Pease | B60R 16/023 701/1 |
| 2013/0144495 | A1 | 6/2013 | Yu | |
| 2017/0030131 | A1 | 2/2017 | Elie et al. | |
| 2017/0030132 | A1 | 2/2017 | Elie et al. | |
| 2017/0144516 | A1* | 5/2017 | Iacovoni | B60J 5/0493 |
| 2017/0197585 | A1* | 7/2017 | Izraeli | H04W 4/80 |
| 2018/0202212 | A1* | 7/2018 | Xiao | E05F 5/025 |
| 2018/0328097 | A1* | 11/2018 | Holt | E05F 15/611 |
| 2018/0367731 | A1* | 12/2018 | Gatti | H04N 5/23238 |

FOREIGN PATENT DOCUMENTS

| | | | |
|---|---|---|---|
| DE | 102007062473 | A1 | 7/2009 |
| DE | 102013226128 | A1 | 6/2015 |
| GB | 2543385 | A | 4/2017 |
| KR | 101650334 | B1 | 8/2016 |
| WO | WO 2017029229 | A1 | 2/2017 |
| WO | WO 2017083706 | A1 | 5/2017 |

* cited by examiner

VEHICLE DOOR ASSISTANCE

TECHNICAL FIELD

The present disclosure generally relates to doors of vehicles and, more specifically, vehicle door assistance.

BACKGROUND

The muscle load and body kinematics required to open and close doors of a vehicle can vary based on various vehicle parameters and environmental factors. Often, the doors are hard to open and close, which can be difficult for drivers and passengers with reduce mobility and reduce strength.

SUMMARY

The appended claims define this application. The present disclosure summarizes aspects of the embodiments and should not be used to limit the claims. Other implementations are contemplated in accordance with the techniques described herein, as will be apparent to one having ordinary skill in the art upon examination of the following drawings and detailed description, and these implementations are intended to be within the scope of this application.

Example embodiments are disclosed for vehicle door assistance. An example vehicle includes a solenoid between a frame of the vehicle and a door, a restraint control module with an accelerometer to provide a roll angle and a pitch angle of the vehicle; and a body control unit. The body control unit determines a door adjustment force based on the roll and pitch angles and personal characteristics of an occupant, and when a door is moving, applies the door adjustment force with the solenoid.

An example method includes determining, via an restrain control module, a pitch angle and a roll angle of a vehicle. The example method also includes determining personal characteristics of an occupant based on a profile associated with a door and determining a door adjustment force based on the roll and pitch angles, a motion of the door relative to the roll and pitch angles, and personal characteristics of an occupant. Additionally, the example method includes, when the door is in motion, applying the door adjustment force with a solenoid positioned between a frame of the door and a frame of the vehicle.

BRIEF DESCRIPTION OF THE DRAWINGS

For a better understanding of the invention, reference may be made to embodiments shown in the following drawings. The components in the drawings are not necessarily to scale and related elements may be omitted, or in some instances proportions may have been exaggerated, so as to emphasize and clearly illustrate the novel features described herein. In addition, system components can be variously arranged, as known in the art. Further, in the drawings, like reference numerals designate corresponding parts throughout the several views.

DETAILED DESCRIPTION OF EXAMPLE EMBODIMENTS

Figure 1:
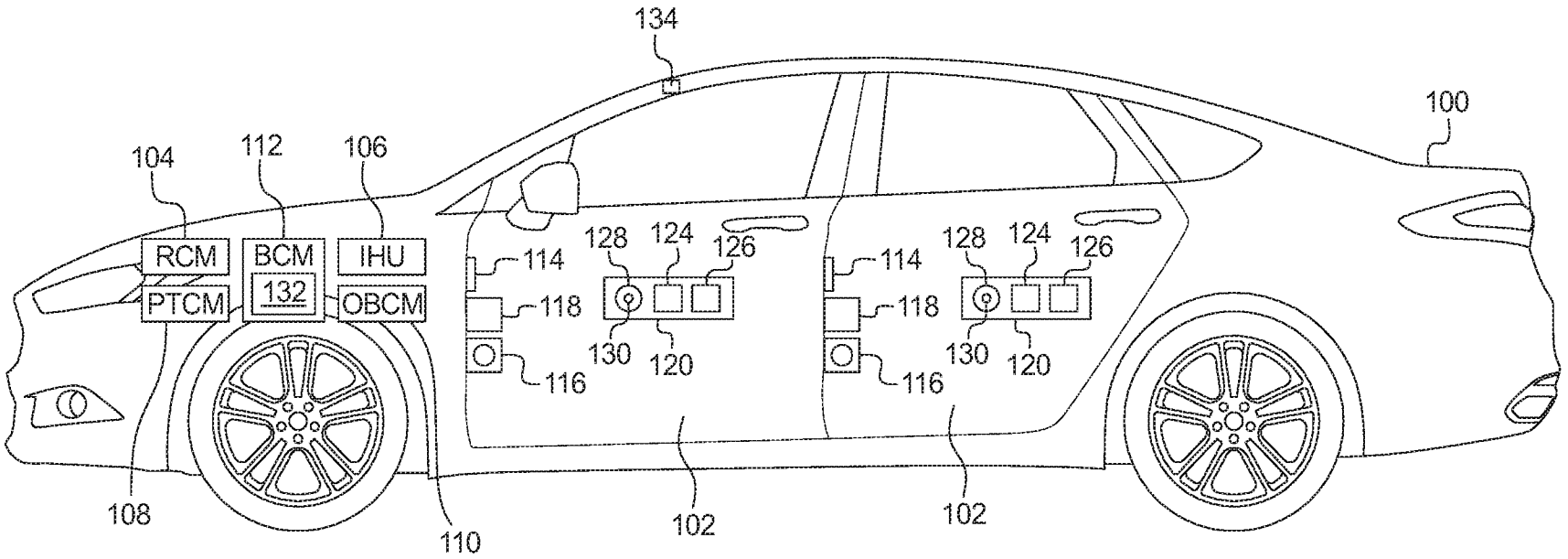
FIG. 1 illustrates a vehicle operating in accordance with the teachings of this disclosure.

While the invention may be embodied in various forms, there are shown in the drawings, and will hereinafter be described, some exemplary and non-limiting embodiments, with the understanding that the present disclosure is to be considered an exemplification of the invention and is not intended to limit the invention to the specific embodiments illustrated.

The muscle load and body kinematics required to open and close doors of a vehicle can vary based on various vehicle parameters, such as door mass, hinge locations, friction, hand position with respect to the door, magnitude and directions of external forces. Additionally, the muscle load and body kinematics required to open and close doors of a vehicle can vary based on the surface that the vehicle is parked on. The surface may have a pitch angle and/or a roll angle. The pitch angle is an angle relative to a flat surface of the vehicle about its lateral axis. The pitch angle is positive when the front of the vehicle is elevated relative to the rear of the vehicle, and negative when the rear of the vehicle is elevated relative to the front of the vehicle. The roll angle is an angle relative to a flat surface of the vehicle about its longitudinal axis. The roll angle is positive when the passenger side (e.g., the right side) of the vehicle is elevated relative to the driver side (e.g., the left side) of the vehicle, and negative when the driver side of the vehicle is elevated relative to the passenger side of the vehicle. For example, when the vehicle is parked on an incline such that the roll angle is negative, opening the driver side doors requires more force than when the vehicle is parked on a flat surface.

As disclosed below, a vehicle includes system to apply a force to doors of the vehicle to assist an occupant opening and closing the doors and/or apply a force to the door in case of an emergency. The system determines the roll angle and pitch angle of the vehicle, the environmental factors (e.g., wind, temperature, etc.) around the vehicle, and/or the direction of the door movement (e.g., opening or closing). In some examples, the system also determines characteristics (e.g., age, strength, ability, etc.) of the occupant handling the door based on a profile and/or settings. Additionally, in some examples, the system determines whether the occupant is struggling with the door (e.g., the door is opening slowly, the door is closing quickly, etc.). Based on these determinations, the system determines an adjustment force to apply to the door with a door assist module (e.g., a hydraulic solenoid, a spring force solenoid, etc.) to assist the occupant with opening or closing the door.

Additionally, in some examples, the system determines when an emergency, such as an accident, has occurred. For example, the system may monitor for the on-board communication module activates emergency assist and/or an occupant pushes an emergency switch embedded in the door. In some examples, the emergency mode may be activated by a transponder controlled by emergency personnel (e.g., a police officer, a fire fighter, an EMT, etc.). When the emergency mode is activated and the exterior or interior door handle is pulled, the door assist module applied an emergency force to the door. In some examples, the emergency force is a maximum amount of force the door assist module can produce.

FIG. 1 illustrates a vehicle 100 operating in accordance with the teachings of this disclosure. The vehicle 100 may be a standard gasoline powered vehicle, a hybrid vehicle, an electric vehicle, a fuel cell vehicle, and/or any other mobility implement type of vehicle. The vehicle 100 includes parts related to mobility, such as a powertrain with an engine, a transmission, a suspension, a driveshaft, and/or wheels, etc. The vehicle 100 may be non-autonomous, semi-autonomous (e.g., some routine motive functions controlled by the vehicle 100), or autonomous (e.g., motive functions are controlled by the vehicle 100 without direct driver input). In the illustrated example the vehicle 100 includes door modules 102, a restraint control module (RCM) 104, an infotainment head unit (IHU) 106, a power train control module (PTCM) 108, an on-board communication module (OBCM) 110, and a body control module (BCM) 112.

The door modules 102 include components embedded into a door and/or a frame of the vehicle 100. In the illustrated example, the door modules include a door position sensor 114, a door assist module 116, an emergency power source 118, and a door control unit 120. The door position sensor 114 provides information about the state of the corresponding door. The information includes the position of the door (e.g., open or closed), the angle of the door (e.g., between opened and closed), the speed of the door being opened/closed, and/or a direction of movement of the door (e.g., between opened and closed), etc.

The door assist module 116 is hardware that includes a device to apply force to the door to deduce the force necessary for an occupant to open or close the door safely (e.g., by reducing the force of the door when it is closing to counteract the gravitational force, etc.). The door assist module 116 also includes control circuitry. The device is positioned to interact with the door and the frame of the vehicle on the hinge side 122 of the door. In some examples, the device is a solenoid. In such examples, the device may be a hydraulic solenoid or a variable-force solenoid. The door assist module 116 is communicatively coupled to the body control module 112. The door assist module 116 receives commands from the body control module 112. The commands include the force to be applied to the door and/or entering an emergency mode. The command may include the force to be applied to the door in a raw force value (e.g., a value in Newtons (N), etc.) or in a percentage (e.g., 50% of the solenoid's maximum force, etc.), etc.

The emergency power source 118 is an energy storage device (e.g., a battery, a high current capacitor, etc.) that is capable of energizing the door assist module 116 in the event that the power bus of the vehicle 100 is no longer supplying power. In some examples, the emergency power source 118 is capable of supplying power to the door assist module 116 for the door assist module to supply an emergency force to the door.

The door control unit 120 includes circuitry to receive commands from the body control module 112 and control operations relating to the door, such as a power window and a power latch. In the illustrated example, the door control unit 120 includes a handle sensor 124, a lock control 126, and a emergency switch 128. The handle sensor 124 detects when the internal and/or external handle of the vehicle 100 is activate/pulled. The handle sensor 124 may be a mechanical switch, a capacitive switch, or an infrared sensor, etc. The lock control 126 controls the latch of the door. The emergency switch 128 is a mechanical switch or button that, when activated puts the vehicle 100 into the emergency mode. In some examples, to prevent accidental triggering, the emergency switch 128 is recessed into the door and/or is covered by a movable panel. The emergency switch 128 may also include a cover to prevent the emergency switch 128 from being accidentally activated. In the illustrated example, the emergency switch 128 includes a lighting element 130, such as a light emitting diode (LED). The LED lights up when, for example, the body control module 112 detects that the vehicle 100 has been involved in an accident.

The restraint control module 104 is an electronic control unit (ECU) that includes an accelerometer and other inertial sensors, such a gyroscope. An electronic control unit is a hardware device that includes circuits, sensors, and/or firmware to provide monitor and/or control functions for a particular set of systems in the vehicle 100. The restraint control module 104 measures and provides the pitch and roll angles to the body control module 112. The restraint control module 104 is typically mounted to the floor of the vehicle 100 between the front seats.

Figure 2A:
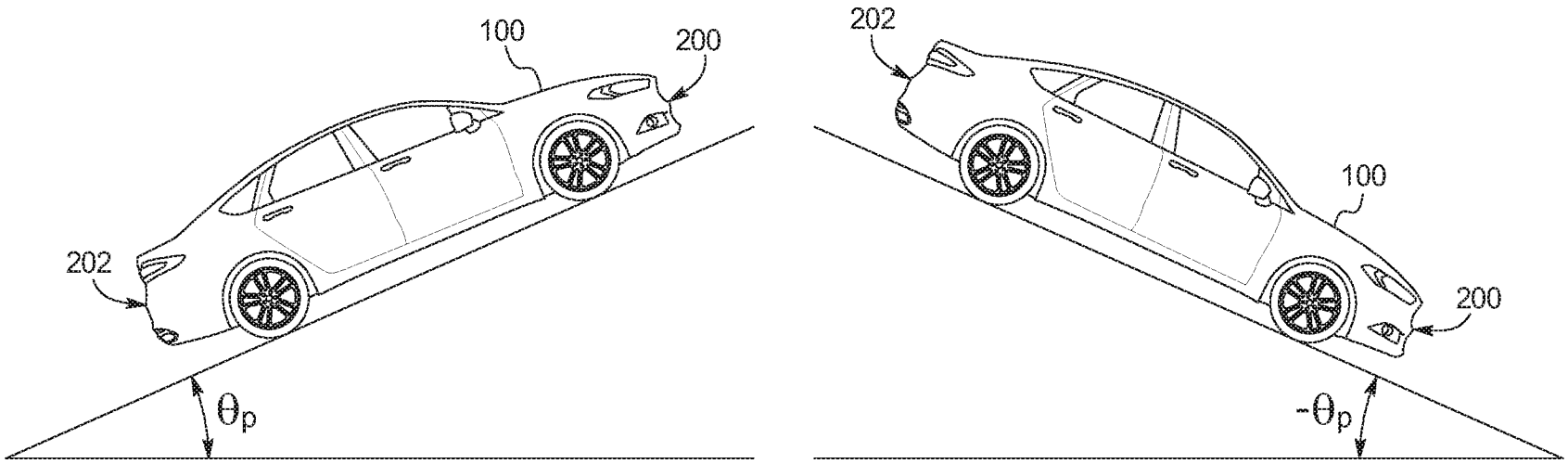
FIG. 2A illustrates the vehicle of FIG. 1 parked on a roadway with a pitch angle.
Figure 2B:
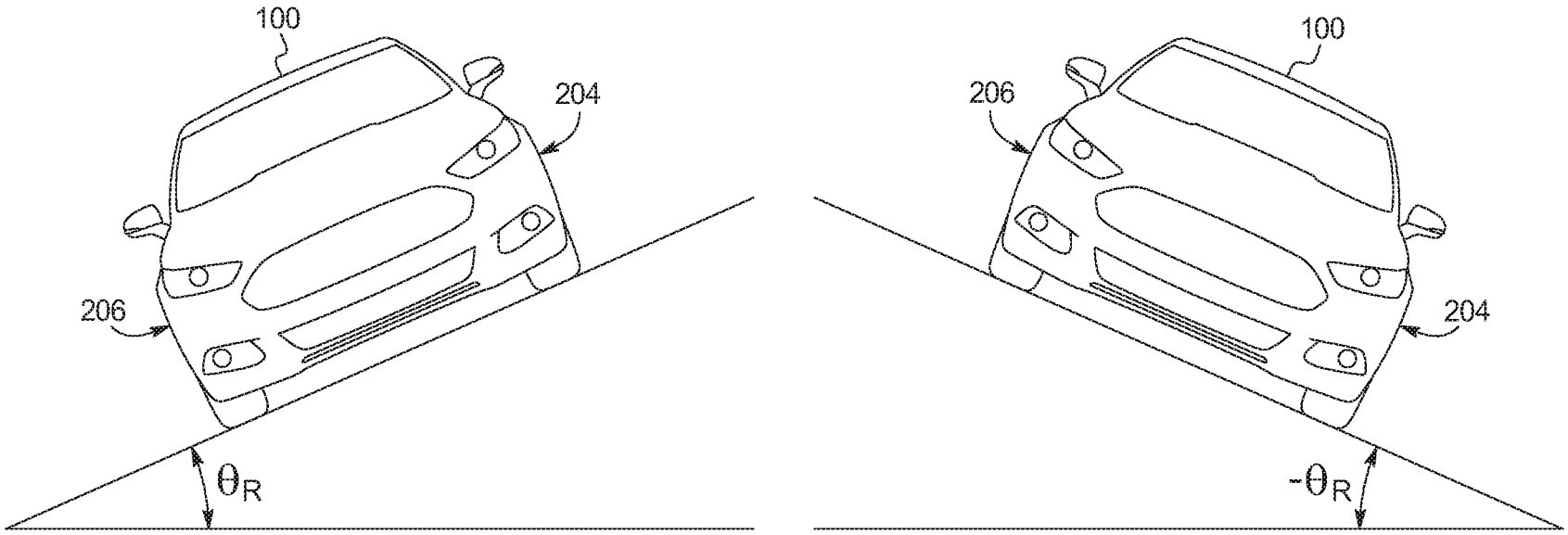
FIG. 2B illustrated the vehicle of FIG. 1 parked on the roadway with a roll angle.

FIGS. 2A and 2B illustrate pitch angles ($\theta_P$) and roll angles ($\theta_R$). The pitch angle ($\theta_P$) and roll angle ($\theta_R$) affect the magnitude that the gravitational force acts on the doors of the vehicle 100. In FIG. 2A, the vehicle 100 is parked longitudinally on an incline. When the front 200 of the vehicle 100 is elevated relative to the rear 202 of the vehicle 100, the pitch angle ($\theta_P$) is positive. When the rear 202 of the vehicle 100 is elevated relative to the front 200 of the vehicle 100, the pitch angle ($\theta_P$) is negative. When the pitch angle ($\theta_P$) is positive, additional force is required to open the door to overcome the effects of the gravitational force and less force or a dampening force is required close the door. Similarly, when the pitch angle ($\theta_P$) is negative, additional force is required to close the door to overcome the effects of the gravitational force and less force or a dampening force is required open the door. In FIG. 2B, the vehicle 100 is parked laterally on a incline. The roll angle ($\theta_R$) is positive when the driver side 204 (e.g., the left side) of the vehicle 100 is elevated relative to the passenger side 206 (e.g., the right side). The roll angle ($\theta_R$) is negative when the passenger side 206 of the vehicle 100 is elevated relative to the driver side 204. When the roll angle ($\theta_R$) is positive, (i) additional force is required to open doors on the driver side 204, (ii) less force or a dampening force is required to close the doors on the driver side 204, (iii) additional force is required to close doors on the passenger side 206, and (iv) force or a dampening force is required to open the doors on the passenger side 206. Similarly, when the roll angle ($\theta_R$) is negative, (i) additional force is required to close doors on the driver side 204, (ii) less force or a dampening force is required to open the doors on the driver side 204, (iii) additional force is required to open doors on the passenger side 206, and (iv) force or a dampening force is required to close the doors on the passenger side 206. In FIG. 2A, the vehicle 100 is illustrated to have a pitch angle ($\theta_P$) and not a roll angle ($\theta_R$). In FIG. 2B, the vehicle is illustrated to have a roll angle ($\theta_R$) and not a pitch angle ($\theta_P$). However, when parked, the vehicle 100 may have a combination of a pitch angle ($\theta_P$) and a roll angle ($\theta_R$) depending on the terrain the vehicle 100 is parked on.

Returning to FIG. 1, the infotainment head unit 106 provides an interface between the vehicle 100 and a user. The infotainment head unit 106 includes digital and/or analog interfaces (e.g., input devices and output devices) to receive input from the user(s) and display information. The input devices may include, for example, a control knob, an instrument panel, a digital camera for image capture and/or visual command recognition, a touch screen, an audio input device (e.g., cabin microphone), buttons, or a touchpad. The output devices may include instrument cluster outputs (e.g., dials, lighting devices), actuators, a heads-up display, a center console display (e.g., a liquid crystal display ("LCD"), an organic light emitting diode ("OLED") display, a flat panel display, a solid state display, etc.), and/or speakers. In some examples, the infotainment head unit 106 includes hardware (e.g., a processor or controller, memory, storage, etc.) and software (e.g., an operating system, etc.) for an infotainment system (such as SYNC® and MyFord Touch® by Ford®, Entune® by Toyota®, IntelliLink® by GMC®, etc.). Additionally, the infotainment head unit 106 displays the infotainment system on, for example, the center console display. The infotainment system may be used to receive preferences and settings from occupants of the vehicle 100. For example, an occupant may use the infotainment system to identify a profile associated with a particular seat and/or characteristics of the person in a particular seat that effect the force applied to the corresponding door. In such a manner, each door may be associated with different profiles and settings.

The power train control module 108 is an electronic control unit that controls functions of the engine system and the transmission system. The power train control module 108 receives measurements from sensors installed around the vehicle 100 to manage the engine of the vehicle 100. The power train control module 108 provides the state of the vehicle transmission (e.g., which gear the vehicle 100 is in, etc.) to the body control module 112.

The on-board communications module 110 includes wired or wireless network interfaces to enable communication with external networks. The on-board communications module 110 also includes hardware (e.g., processors, memory, storage, antenna, etc.) and software to control the wired or wireless network interfaces. In the illustrated example, the on-board communications module 110 includes one or more communication controllers for standards-based networks (e.g., Global System for Mobile Communications (GSM), Universal Mobile Telecommunications System (UMTS), Long Term Evolution (LTE), Code Division Multiple Access (CDMA), WiMAX (IEEE 802.16m); local area wireless network (including IEEE 802.11 a/b/g/n/ac or others), dedicated short range communication (DSRC), and Wireless Gigabit (IEEE 802.11ad), etc.).

In some examples, the on-board communications module 110 includes a wired or wireless interface (e.g., an auxiliary port, a Universal Serial Bus (USB) port, a Bluetooth® wireless node, etc.) to communicatively couple with a mobile device (e.g., a smart phone, a smart watch, a tablet, etc.). In such examples, the vehicle 100 may communicate with the external network via the coupled mobile device. The external network(s) may be a public network, such as the Internet; a private network, such as an intranet; or combinations thereof, and may utilize a variety of networking protocols now available or later developed including, but not limited to, TCP/IP-based networking protocols.

In some examples, the on-board communications module 110 includes an emergency assist system. When the emergency assist system detects that the vehicle has been involved in an accident (e.g., detects that an air bag has been deployed, etc.), the emergency assist system contacts emergency services. Additionally, in some examples, the emergency assist system activates an emergency mode.

The body control module 112 controls various subsystems of the vehicle 100. For example, the body control module 112 may control power windows, power locks, an immobilizer system, and/or power mirrors, etc. The body control module 112 includes or is communicatively coupled to circuits to, for example, drive relays (e.g., to control wiper fluid, etc.), drive brushed direct current (DC) motors (e.g., to control power seats, power locks, power windows, wipers, etc.), drive stepper motors, and/or drive LEDs, etc. In the illustrated example, the body control module 112 a door assister 132. The door assister 132 provides a door adjustment force and/or an emergency force to a door via the door assist module 116. The door adjustment force applies a positive or negative force to assist opening and closing the door. The emergency force applies a positive force to assist opening the door when the vehicle 100 is in an emergency mode.

The door assister 132 calculates the door adjustment force based on (a) the pitch and roll angles of the vehicle 100, (b) the position of the door being opened/closed relative to the pitch and roll angles of the vehicle 100, (c) vehicle parameters, such as door mass, hinge locations, friction, hand position with respect to the door, (d) magnitude and directions of external forces (e.g., wind, etc.), and/or (e) physical attributes (e.g., age, health, medical condition, body size, ability, etc.) of the occupant opening a door based on a profile and/or settings entered into the infotainment system. The door assister 132 includes a multi-factor look up table that are generated by simulations and/or empirical testing. Physical or virtual data is analyzed utilizing numerical regression techniques to develop a mathematical polynomial function that provides confidence without complexity. In some examples, the polynomial function that is the basis of the look-up table is based on a design of experiment matrix using full factorial design or fractional factorial design techniques.

In some examples, the door assister 132 receives the physical attributes if the occupant(s) of the vehicle 100 via the infotainment head unit 106. In some such examples, the infotainment head unit 106 identifies a profile of the occupant(s) (e.g., by recognizing a paired mobile device/key fob, by manual entry, by biometric identification, by facial recognition via a camera 134, etc.). Additionally or alternatively, in some examples, the infotainment system provides a graphical user interface in which the occupant can select profiles, manually specify physical attributes of the occupants, and/or associate settings with particular doors, etc.

To calculate the door adjustment force, the door assister 132 determines the pitch and roll angle of the vehicle 100 from the restraint control module 104. The door assister 132 then determines the environmental factors, such as the direction and strength of the wind, proximate the vehicle 100. The door assister 132 monitors the doors for movement via the door position sensor 114 and/or the handle sensor 124. When movement is detection, the door assister 132 determines which door is being moved. The door assister 132 classifies the movement of the door based on (a) whether the door is opening or closing and (b) the directions of the gravitational force on the door being moved accounting for (i) the pitch and roll angles of the vehicle 100 and (ii) the relative position of the door to the pitch and roll angles. For example, when the pitch is positive, the gravitational force will cause the door to require less force to open or, depending on the angle, open without any additional force from the occupant. The look-up table provides a factor that specifies a force or setting for the door assist module 116 to apply to the door. The force or setting may specify in a raw force value (e.g., a value in Newtons (N), etc.) or in a percentage (e.g., 50% of a maximum available force of the door assist module 116, etc.), etc.

When the door is associated with a profile or settings, the door assister 132 determines, via the look-up table, the door adjustment force based on the roll and pitch angles of the vehicle, the environmental factors, the door movement classification, and the physical attributes of the occupant associated with the profile or settings. For example, when (1) the pitch angle is positive, (2) the driver side door is being opened, (3) wind is blowing from the aft of the vehicle 100 to the front of the vehicle 100, and (4) the profile identifies that the corresponding occupant is small in stature, the door assister 132 may determine a negative door adjustment force to counteract the other forces that may cause the door to open quickly. As another example, when (1) the roll angle is positive, (2) the passenger side door is being opened, and (3) the profile indicates that the corresponding occupant is at least sixty years old, the door assister 132 may determine a positive door adjustment force to assist opening the door.

In some examples, the door assister 132 determines whether the occupant opening or closing the door is struggling. In such examples, when the occupant opening or closing the door is struggling, the door assister 132 adjusts the door adjustment force. For example, if the occupant is struggling to open the door, the door assister 132 may increase the door adjustment force. The door adjustment force. The door assister 132 determines whether the occupant is struggling based on image recognition via the camera 134 and/or motion detected by the door position sensor 114. For example, jerky movement of the door detected by the door position sensor 114 may indicate that the occupant is struggling. In such examples, when struggling is detected, the door assister 132 increases or decreases the door adjustment force supplied by the door assist module 116 depending on the movement of the door and the pitch and roll angles relative to the door.

When the door assister 132 determines that the door is not associated with a profile or settings and does not detect the occupant struggling, the door assister 132 determines, via the look-up table, the door adjustment force based on the roll and pitch angles of the vehicle, the environmental factors, the door movement classification.

Figure 3:
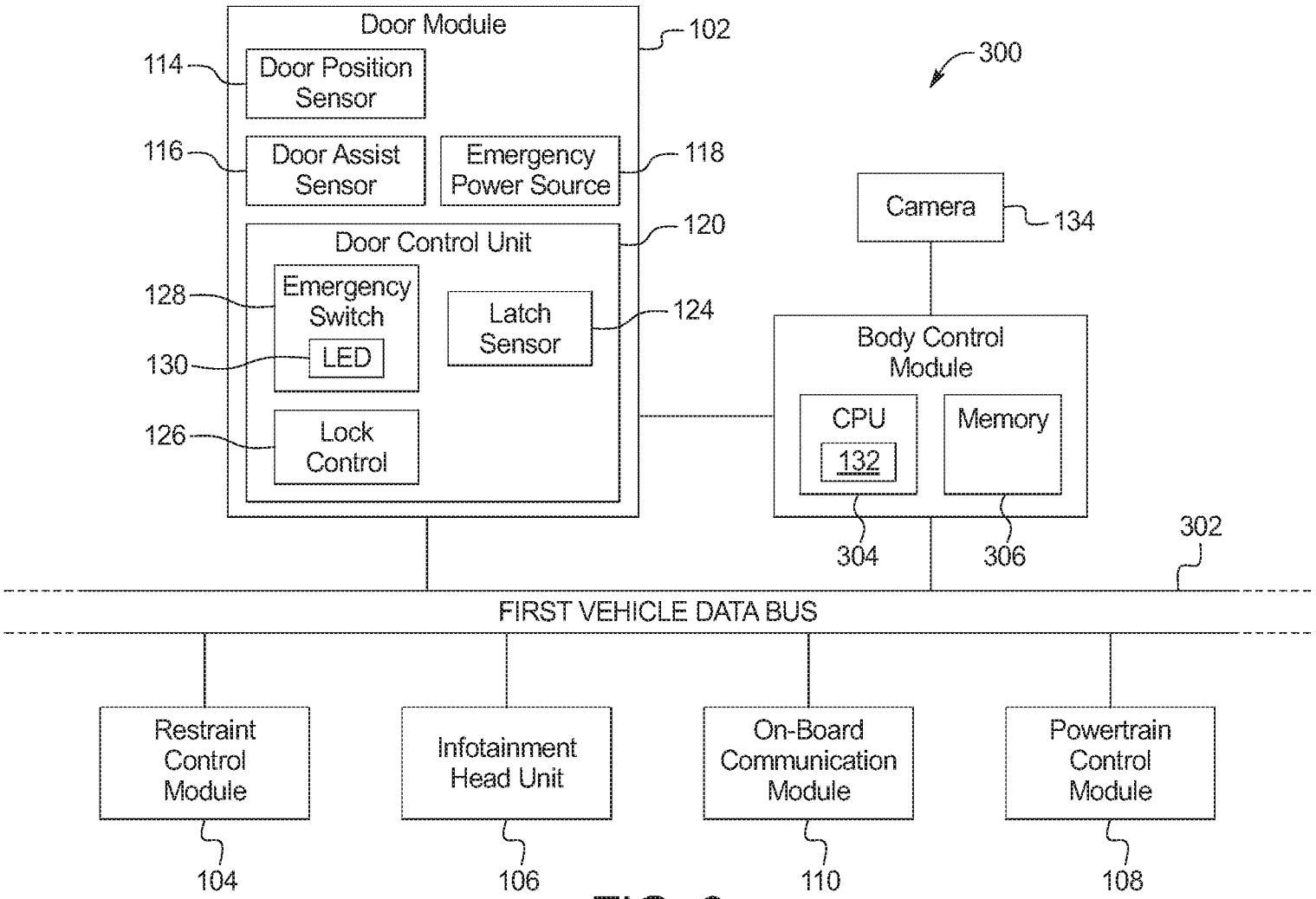
FIG. 3 depicts a block diagram of the electronic components of the vehicle of FIG. 1.

FIG. 3 depicts a block diagram of the electronic components 300 of the vehicle 100 of FIG. 1. The illustrated example, the electronic components include the door modules 102, the restraint control module 104, the infotainment head unit 106, the power train control module 108, the on-board communications module 110, the body control module 112, and a vehicle data bus 302.

The body control module 112 includes a processor or controller 304 and memory 306. In the illustrated example, the body control module 112 is structured to include door assister 132. The processor or controller 304 may be any suitable processing device or set of processing devices such as, but not limited to: a microprocessor, a microcontroller-based platform, a suitable integrated circuit, one or more field programmable gate arrays (FPGAs), and/or one or more application-specific integrated circuits (ASICs). The memory 306 may be volatile memory (e.g., RAM, which can include non-volatile RAM, magnetic RAM, ferroelectric RAM, and any other suitable forms); non-volatile memory (e.g., disk memory, FLASH memory, EPROMs, EEPROMs, non-volatile solid-state memory, etc.), unalterable memory (e.g., EPROMs), read-only memory, and/or high-capacity storage devices (e.g., hard drives, solid state drives, etc). In some examples, the memory 306 includes multiple kinds of memory, particularly volatile memory and non-volatile memory.

The memory 306 is computer readable media on which one or more sets of instructions, such as the software for operating the methods of the present disclosure can be embedded. The instructions may embody one or more of the methods or logic as described herein. In a particular embodiment, the instructions may reside completely, or at least partially, within any one or more of the memory 306, the computer readable medium, and/or within the processor 304 during execution of the instructions.

The terms "non-transitory computer-readable medium" and "tangible computer-readable medium" should be understood to include a single medium or multiple media, such as a centralized or distributed database, and/or associated caches and servers that store one or more sets of instructions. The terms "non-transitory computer-readable medium" and "tangible computer-readable medium" also include any tangible medium that is capable of storing, encoding or carrying a set of instructions for execution by a processor or that cause a system to perform any one or more of the methods or operations disclosed herein. As used herein, the term "tangible computer readable medium" is expressly defined to include any type of computer readable storage device and/or storage disk and to exclude propagating signals The vehicle data bus 302 communicatively couples the restraint control module 104, the infotainment head unit 106, the power train control module 108, the on-board communications module 110, and the body control module 112. In some examples, the vehicle data bus 302 includes one or more data buses. The vehicle data bus 302 may be implemented in accordance with a controller area network (CAN) bus protocol as defined by International Standards Organization (ISO) 11898-1, a Media Oriented Systems Transport (MOST) bus protocol, a CAN flexible data (CAN-FD) bus protocol (ISO 11898-7) and/a K-line bus protocol (ISO 9141 and ISO 14230-1), and/or an Ethernet™ bus protocol IEEE 802.3 (2002 onwards), etc.

Figure 4:
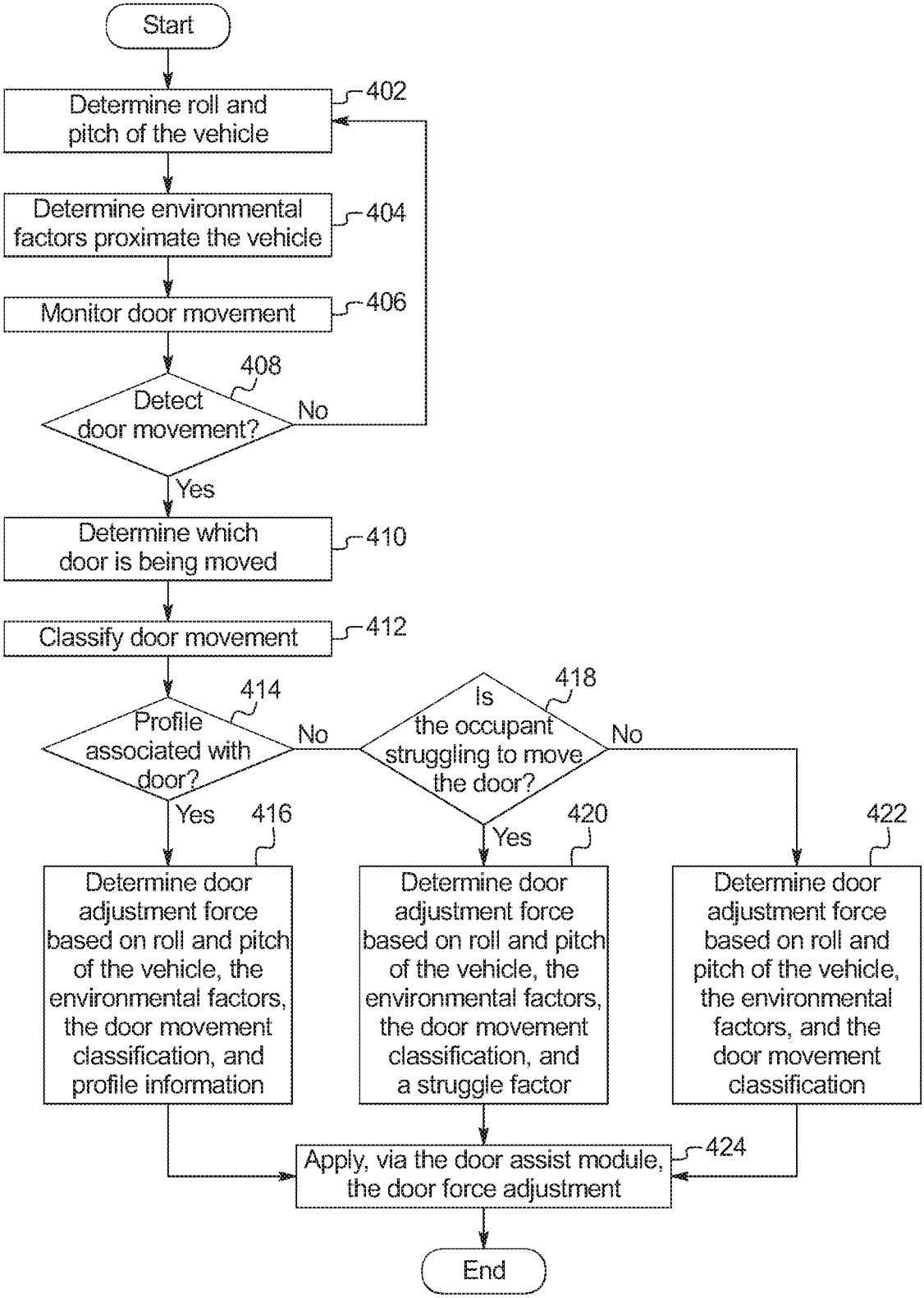
FIG. 4 is a flowchart of a method to apply a door adjustment force to a door of the vehicle of FIG. 1, which may be implemented by the electronic components of FIG. 3.

FIG. 4 is a flowchart of a method to apply a door adjustment force to a door of the vehicle 100 of FIG. 1, which may be implemented by the electronic components 300 of FIG. 3. The door assister 132 beings the method of FIG. 3 when the vehicle 100 is stopped, as communicated by the power train control module 108. Initially, at block 402, the door assister 132 determines the roll and pitch angles of the vehicle 100 via the restraint control module 104. At block 404, the door assister 132 determines environmental factors proximate the vehicle 100. For example, the door assister 132 may determine the wind velocity via the on-board communications module 110 and determine the orientation of the vehicle 100 via the restraint control module 104. At block 406, the door assister 132 monitors the movement of the doors via the door position sensors 114. At block 408, the door assister 132 determines whether door movement was detected. When door movement is detected, the method continues to block 410. Otherwise, then door movement is not detected, the method returns to block 402.

At block 410, the door assister 132 determines which door is moving. At block 412, the door assister 132 classifies the door movement. To classify the door movement, the door assister 132 determines (a) whether the door is opening or closing and (b) the directions of the gravitational force on the door being moved accounting for (i) the pitch and roll angles of the vehicle 100 and (ii) the relative position of the door to the pitch and roll angles. At block 414, the door assister 132 determines whether a profile and/or settings is/are associated with the moving door. When a profile and/or settings is/are associated with the moving door, the method continues to block 416. Otherwise, when a profile and/or settings is/are not associated with the moving door, the method continues to block 418. At block 416, the door assister 132 determines the door adjustment force based on the roll and pitch angles of the vehicle 100, the environmental factors, the door movement classification, and the profile/settings information.

At block 418, the door assister 132 determines whether the occupant associated with the moving door is struggling to open or close the door. When the occupant associated with the moving door is struggling, the method continues at block 420. Otherwise, when the occupant associated with the moving door is not struggling, the method continues at block 422. At block 420, the door assister 132 determines the door adjustment force based on the roll and pitch angles of the vehicle 100, the environmental factors, the door movement classification, and a struggle factor. At block 422, the door assister 132 determines the door adjustment force based on the roll and pitch angles of the vehicle 100, the environmental factors, the door movement classification. At block 424, the door assister 132 applies the door adjustment force to the moving door via the door assist module 116.

Figure 5:
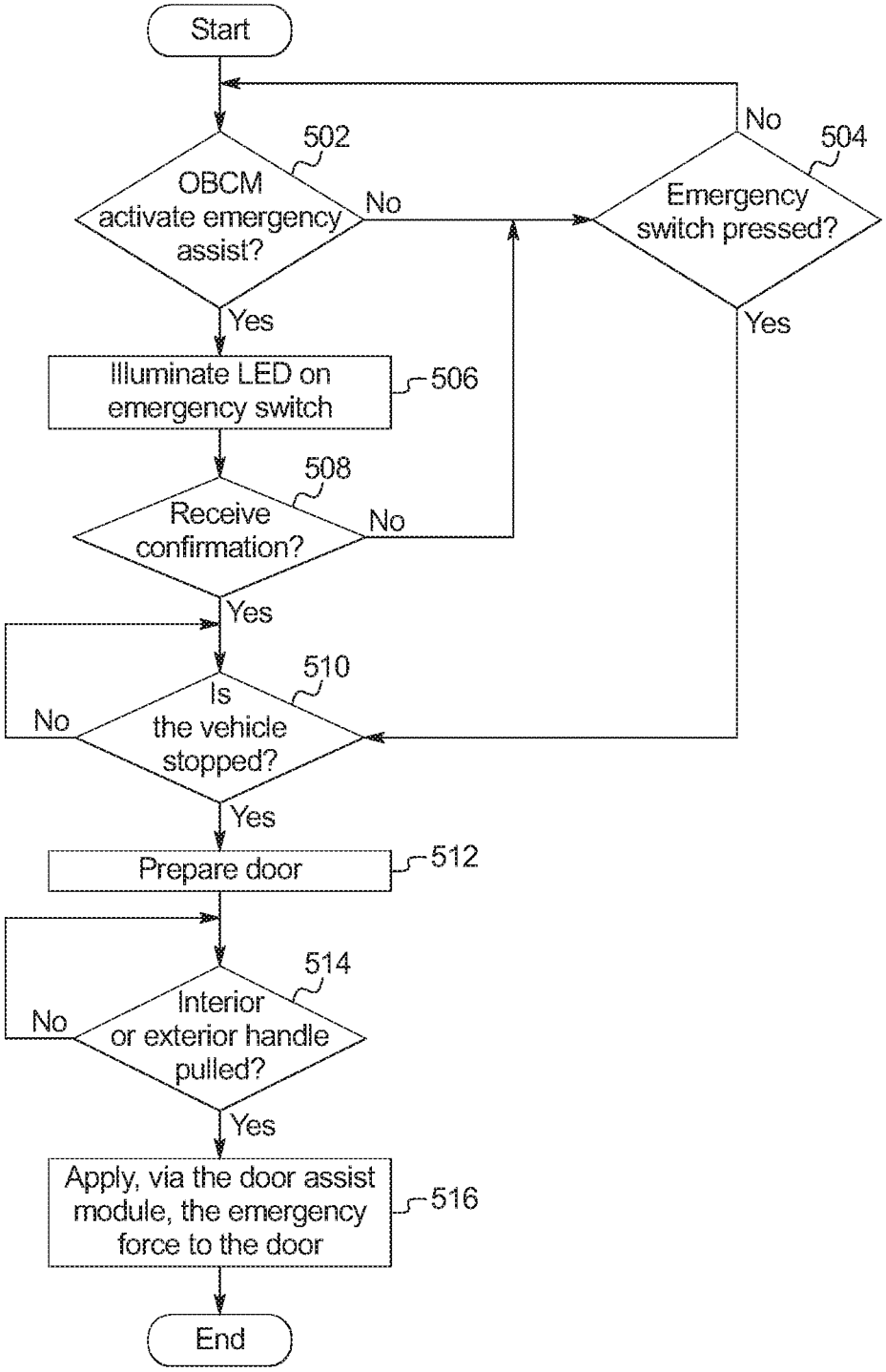
FIG. 5 is a flowchart of a method to apply an emergency force to the door of the vehicle of FIG. 1, which may be implemented by the electronic components of FIG. 3.

FIG. 5 is a flowchart of a method to apply an emergency force to the door of the vehicle of FIG. 1, which may be implemented by the electronic components of FIG. 3. Initially, the door assister 132 waits until the on-board communications module 110 activates emergency assist (block 502) or the emergency switch 128 is pressed (block 504). At block 506, the door assister 132 illuminates the lighting element 130. At block 508, the door assister 132 determines whether it has received confirmation of an emergency. In some examples, the confirmation may be received via an interface on the infotainment head unit 106. Alternatively or additionally, in some examples, the confirmation is received from a transponder operated by an emergency responder via the on-board communications module 110. At block 510, when the confirmation is received or the emergency switch 128 is activated, the door assister 132 waits until the vehicle 100 is stopped. At block 512, when the vehicle 100 is stopped, the door assister 132 prepares the doors of the vehicle 100 to be opened. For example, the door assister 132 may cause the lock control 126 to unlock and unlatch the doors. At block 514, the door assister 132 waits until the interior or exterior handle of the vehicle 100 is pulled. At block 516, when the interior or exterior handle of the vehicle 100 is pulled, the door assister 132 applies the emergency force to the door via the door assist module 116.

The flowcharts of FIGS. 4 and 5 are representative of machine readable instructions stored in memory (such as the memory 306 of FIG. 3) that comprise one or more programs that, when executed by a processor (such as the processor 304 of FIG. 3), cause the vehicle 100 to implement the example door assister 132 of FIGS. 1 and 3. Further, although the example program(s) is/are described with reference to the flowcharts illustrated in FIGS. 4 and 5, many other methods of implementing the example door assister 132 may alternatively be used. For example, the order of execution of the blocks may be changed, and/or some of the blocks described may be changed, eliminated, or combined.

The above-described embodiments, and particularly any "preferred" embodiments, are possible examples of implementations and merely set forth for a clear understanding of the principles of the invention. Many variations and modifications may be made to the above-described embodiment(s) without substantially departing from the spirit and principles of the techniques described herein. All modifications are intended to be included herein within the scope of this disclosure and protected by the following claims. As used here, the terms "module" and "unit" refer to hardware with circuitry to provide communication, control and/or monitoring capabilities, often in conjunction with sensors. "Modules" and "units" may also include firmware that executes on the circuitry. The terms "includes," "including," and "include" are inclusive and have the same scope as "comprises," "comprising," and "comprise" respectively.

What is claimed is:

1. A vehicle comprising:

a solenoid between a frame of the vehicle and a door;

a restraint control module with an accelerometer to provide a roll angle and a pitch angle of the vehicle; and a body control module including a processor to:

determine one or more physical attributes of an occupant of the vehicle based on a profile of the occupant;

determine a door adjustment force based on at least one of the roll angle, the pitch angle, or the one or more physical attributes of the occupant; and when the door is moving, apply the door adjustment force with the solenoid.

2. The vehicle of claim 1, wherein the body control module is to identify the door that is moving.

3. The vehicle of claim 1 including an emergency switch recessed into a body of the door, and wherein the body control module is to enter an emergency mode in response to activation of the emergency switch.

4. The vehicle of claim 3, wherein in the emergency mode, the body control module is to:

unlock and unlatch the door; and in response to an activation of at least one of an internal handle or an external handle, apply an emergency force to the door via the solenoid.

5. The vehicle of claim 1, including an on-board communications platform, and wherein the body control module is to enter an emergency mode in response to the on-board communications platform activating emergency assist and receiving confirmation that an accident occurred.

6. The vehicle of claim 5, wherein in the emergency mode, the body control module is to, in response to an activation of at least one of an internal handle or an external handle, apply an emergency force to the door via the solenoid.

7. The vehicle of claim 5, wherein the body control module is to receive the confirmation from at least one of the occupant via an interface in the vehicle or an emergency responder from a transponder outside the vehicle.

8. A method comprising:

determining, via a restrain control module, at least one of a pitch angle and a roll angle of a vehicle;

retrieving information from a profile of an occupant of the vehicle, the profile comprising one or more physical attributes of the occupant;

determining, with a processor, a door adjustment force based on at least one of the roll angle, the pitch angle, or the one or more physical attributes of the occupant; and applying the door adjustment force with a solenoid positioned between a frame of the vehicle and a door of the vehicle, to assist the occupant move the door.

9. The method of claim 8, including entering an emergency mode in response to activation of an emergency switch recessed into the door.

10. The method of claim 9, including, in response to entering the emergency mode:

unlocking and unlatching the door; and in response to an activation of at least one of an internal handle or an external handle, applying an emergency force to the door via the solenoid.

11. The method of claim 8, including entering an emergency mode in response to an on-board communications platform activating emergency assist and receiving confirmation that an accident occurred.

12. The method of claim 11, in response to entering the emergency mode:

unlocking and unlatching the door; and in response to an activation of at least one of an internal handle or an external handle, apply an emergency force to the door via the solenoid.

13. The method of claim 11, including receiving the confirmation from at least one of the occupant via an interface in the vehicle or an emergency responder from a transponder outside the vehicle.

* * * * *